United States Patent [19]

Haines

[11] Patent Number: 4,903,626

[45] Date of Patent: Feb. 27, 1990

[54] PLANING MOTOR BOAT HULL

[76] Inventor: John S. Haines, Brisbane, Australia

[21] Appl. No.: 207,580

[22] Filed: Jun. 16, 1988

[30] Foreign Application Priority Data

Jun. 16, 1987 [AU] Australia ..... PI2491

[51] Int. Cl.[4] ..... B63B 1/00

[52] U.S. Cl. ..... 114/56; 114/291

[58] Field of Search ..... 114/56, 288, 290, 291, 114/289, 356, 357, 358; D12/300, 313, 314

[56] References Cited

U.S. PATENT DOCUMENTS

| | | | |
|---|---|---|---|
| 3,091,206 | 5/1963 | Cale | 114/291 |
| 3,117,544 | 1/1964 | Schoell | 114/56 |
| 3,477,400 | 11/1969 | Walker | 114/291 |
| 3,625,173 | 12/1971 | Mitton | 114/291 |
| 4,022,143 | 5/1977 | Krenzler | 114/56 |
| 4,027,613 | 6/1977 | Wollard | 114/291 |
| 4,193,369 | 3/1980 | Talamantes | 114/56 |
| 4,231,314 | 11/1980 | Peters | 114/56 |
| 4,492,176 | 1/1985 | Arima | 114/56 |
| 4,509,927 | 4/1985 | Ikeda | 114/291 |
| 4,726,310 | 2/1988 | Ard et al. | 114/291 |

FOREIGN PATENT DOCUMENTS

| | | |
|---|---|---|
| 1199658 | 7/1970 | United Kingdom . |
| 1231815 | 5/1971 | United Kingdom . |
| 1361936 | 7/1974 | United Kingdom . |
| 1542639 | 3/1979 | United Kingdom . |

*Primary Examiner*—Sherman D. Basinger
*Assistant Examiner*—Stephen P. Avila
*Attorney, Agent, or Firm*—Nixon & Vanderhye

[57] ABSTRACT

A planing boat hull including a bow, a transom, a keel and an underside having:

a. a transverse step adjacent the transom which extends partially the width of the underside; and b. a recess bounded by the transverse step and a pair of side walls and having an open transom end.

The hull underside may further include a pair of substantially planar portions wherein each portion is located adjacent to a respective side wall of the recess. The hull underside may further include a plurality of lift strakes including an outermost lift strake terminating at or adjacent the transom, one or more intermediate lift strakes terminating short of the transom and the outermost lift strake and an innermost lift strake located adjacent to the keel terminating short of the transom end(s) of the one or more intermediate lift strakes.

12 Claims, 3 Drawing Sheets

PLANING MOTOR BOAT HULL

This invention relates to a planing motor boat hull of the type including a transverse step or shoulder intermediate its length.

Boat hulls of this type are known and one example is U.S. Pat. No. 4,027,613 to Wollard which describes a planing hull having a V shaped bottom section which extends from the bow to a shoulder located aft of amidships and a section aft of the shoulder comprising a generally horizontal bottom wall bounded by opposed longitudinal continuations or extensions of sloping walls of the V-shaped bottom section.

The planing boat hull of the type described in Wollard suffered from the disadvantage that often during travel a seal of suction developed which was created by water flow when the hull was attempting to plane by allowing the ingress of air to water located below the horizontal bottom wall. This meant that quite often satisfactory planing performance was not obtained.

Another conventional type of hull incorporating a transverse step or shoulder was U.S. Pat. No. 4,231,314 to Peters which described a hydroplane boat having a generally V shaped hull with a transverse shoulder or step located amidships and vents located in the step so as to provide air intakes which enabled air to gain access to the underside of the hull. The provision of the vents substantially overcame the problem of creation of the seal or suction as described above in regard to Wollard. However, the transverse step of Peters extended the full width of the bottom surface of the hull and was located approximately 50 to 60% of the waterline length forward of the transom. This meant that the water leaving the step next comes into contact with the hull underside in the transom area. Subsequently the hull of Peters functioned as a hydroplane which means that the hull in its planing attitude was supported in two major areas. One support area was located adjacent and forward of the step and the other support area was located at the transom. The water contact at the transom in Peters subsequently provided turbulence which interfered with propeller driving efficiency.

It therefore is an object of the invention to provide a planing boat hull which at least partially alleviates the aforementioned disadvantages of the prior art.

The planing boat hull of the invention therefore includes a bow, a transom, a keel and an underside having a transverse step adjacent the transom which extends only partially the width of the underside to thereby provide a recess having a pair of side walls. The board hull may also include a pair of outer substantially planar portions with each planar portion being located to a respective side wall of the recess.

The remainder of the hull underside is preferably corrugated having a plurality of lift strakes on each side of the keel. Preferably 2–4 planing strakes are provided on each side of the keel wherein an outermost planing strake may terminate at or adjacent the transom, an intermediate strake or strakes may terminate short of the transom end of the outermost strake and an innermost strake is located adjacent to the keel terminated short of the transom end(s) of the intermediate strake(s).

There also may be provided venting means communicating with atmosphere above the waterline which is associated with the aforementioned transverse step. In operation the recess has a base surface or undersurface which functions as a reduced pressure area and thus avoids water turbulence. The purpose of the venting means is to facilitate the breakage of the aforementioned seal or suction created by water flow when the hull is attempting to plane by allowing the ingress of air to water located below the recess.

The venting means may be of any suitable type. In one embodiment the venting means may comprise a conduit or aperture communicating with the undersurface of the recess. Preferably, the conduit or aperture is substantially vertically oriented and communicates with the interior of the hull.

In another embodiment the venting means may comprise a slot or groove located in the underside of the recess which communicates with air above the waterline so as to break the aforesaid suction or seal. Preferably the slot or groove is oriented transversely to the longitudinal axis of the hull or the keel.

Reference may now be made to a preferred embodiment of the invention as shown in the drawings annexed thereto. In these drawings.

Figure 1:
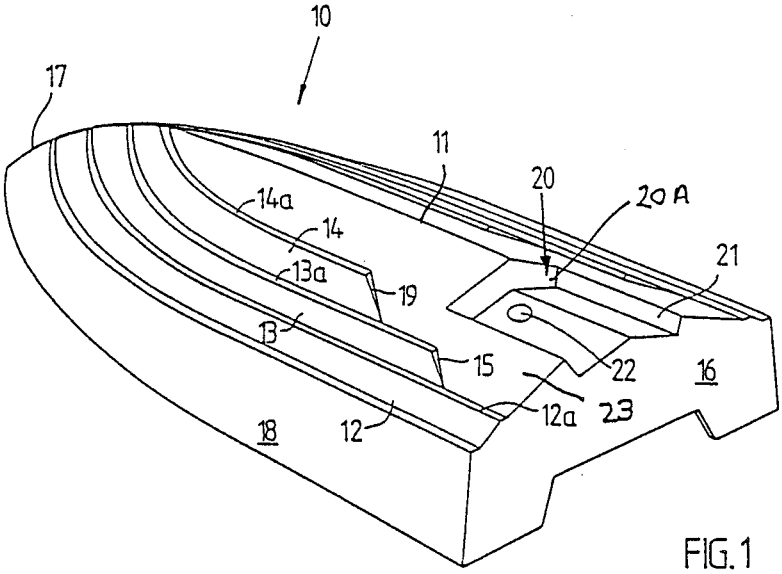
FIG. 1 is a perspective view of the underside of a motor boat hull constructed in accordance with the invention.

In FIG. 1 there is shown planing motor boat hull 10 including keel 11, planing strakes 12, 13 and 14, transom 16, bow 17 and sides 18. Planing strakes 13 and 14 have transom ends 15 and 19. There is also shown recess 20 including transverse step 20A which corresponds to a rear wall of the recess 20. The recess 20 also includes opposed side walls 21. There is also included venting passage 22. Strakes 12 are provided which extend the full length of the hull 10 as shown. Strakes 12, 13 and 14 are provided with planar portions 12A, 13A and 14A as shown. Outer planar portions 23 are also shown. Outer portions 23 are located adjacent each side wall 21 of recess 20.

Figure 2:
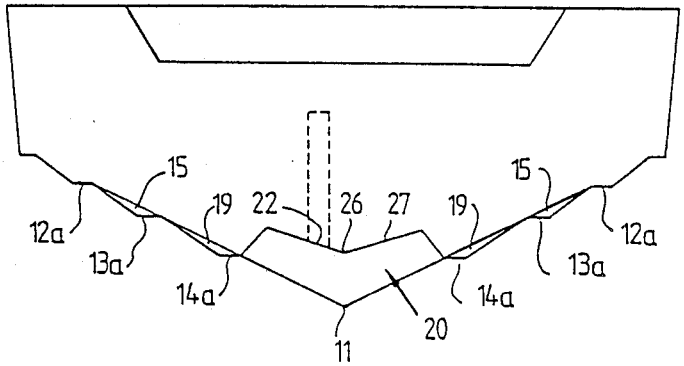
FIG. 2 is a transom end view of the hull of FIG. 1 incorporating one form of venting means.

The recess 20 has a cross sectional profile best shown in FIG. 2 having a medial axis 26 and adjoining base portions 27 of recess 20.

Planing strakes 12, 13 and 14 control the lift created by water flow when the hull 10 is in motion.

This is achieved by changing the direction of the flow of the water, thus creating lift. It is very desirable to vary the length of the strakes to control the longitudinal lift of the hull 10.

It is to be understood that the load carrying ability of a planing hull is directly relevant to the amount of lift generated by the hull. Positioning of the load, therefore, is important as the lift generated in the hull 10 must be generated in the required area to carry that load in a correct planing attitude.

The desirable attitude is between zero and eight degrees angle of attack. To control this angle of attack within the optimum zero and eight degrees, it is desirable to control the longitudinal lift. Planing strakes 12, 13 and 14 are terminated at varying intervals as shown to achieve this goal.

For example, if planing strakes 13 and 14 were continued through to the stern of the boat as planing strakes 12 are, more lift would be generated. Because the planing area of a mono-hull is usually triangular in shape, with the base of the triangle being at the transom or stern and the apex of the triangle being towards the bow, considerably more lift is generated because of the increased planing area at the stern.

So to carry the strakes through to the stern, generating even further lift, would create an undesirable planing attitude when the load is being carried forward. The partial width step 20A is suitably located approximately 0.6 to 0.7 meters ahead of the transom 16. More broadly the step 20A may be located between 5–15% of the waterline length of the hull forward of the transom. Step 20A is provided mainly to position the propeller of a motor in the most efficient area in relation to turbulence created by the boat hull 10.

The propeller can be raised to a higher position which reduces the amount of outboard gear case in the water reducing the drag. Situated in the area just astern of the step 20A is a ventilating tube 22. The tube 22 permits air to pass into recess 20 to reduce the suction created by flow of water over the step 20A when power is applied and forward motion is achieved.

If this air is not permitted to enter this area at the step 20A, planing of the boat may be difficult because the more power applied from the engine, the more flow of water over this step 20A is created.

A further feature of terminating planing strakes 13 and 14 ahead of the transom 16 is that in doing so, a low pressure and turbulent area is created, thus reducing the drag in adjacent planing areas. This feature is further enhanced because of the larger step area created by the inclusion of the variable deadrise configuration; namely, the triangles 15 and 19 shown which correspond to the ends of strakes 13 and 14.

Figure 3:
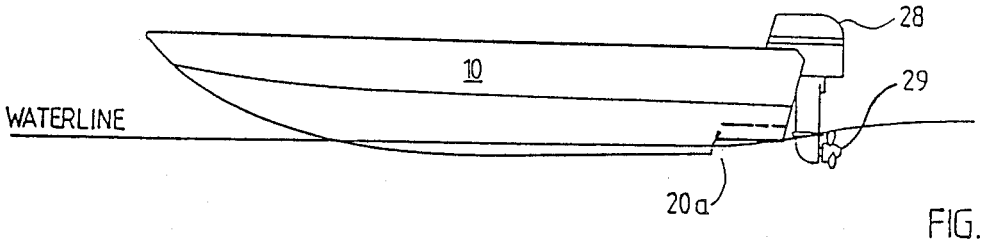
FIG. 3 is a side view of the hull shown in FIG. 1.
Figure 4:
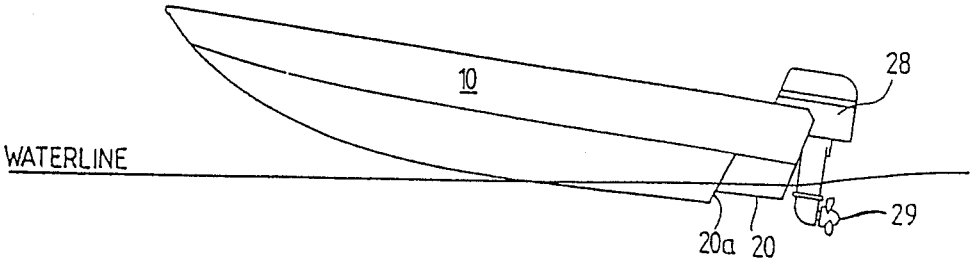
FIG. 4 is a side view of a boat hull not in accordance with the invention having a transverse step extending the full width of the hull underside.

The provision of step 20A provides advantages as best illustrated in FIGS. 3–4. A conventional boat hull when it planes at low speed has a propeller submerged below the waterline as best shown in FIG. 4 which reduces engine efficiency because the propeller is not shown at its most efficient depth. The provision of recess 20 and corrugated or planar outer portions 23 as shown in FIG. 3 increase the amount of hull underside which is in contact with the water because in regard to step 20A at low speeds the undersurface or base surface of recess 20 is not in water contact at low speeds. This means that because of the greater water support there is created an increased uplift under the hull at low speed negating the counteracting weight of the engine acting vertically downwardly. This means that the propeller is maintained at its most efficient water depth in regard to the waterline so that more effective planing can be achieved at low speed. Thus boat hulls of the type shown in FIG. 4 may plane at around 3000 rpm minimum while the hull shown in FIGS. 1–3 may plane effectively at around 1800–2000 rpm minimum. In FIGS. 3–4 there is also shown outboard motor 28 and associated propeller 29.

Figure 5:
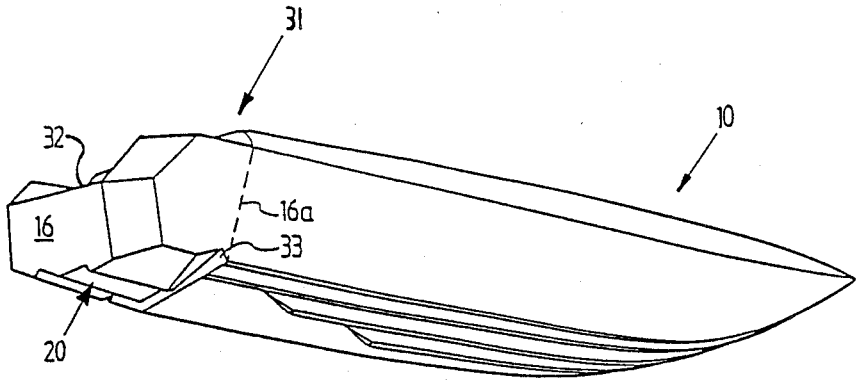
FIG. 5 is a perspective view of the hull shown in FIG. 1, incorporating a different form of venting means.
Figure 6:
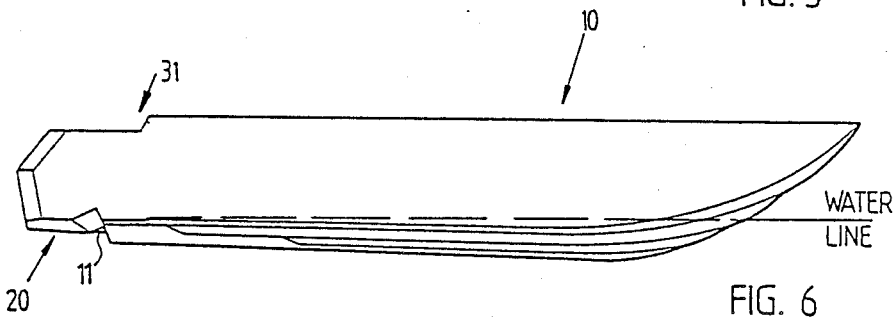
FIG. 6 is a side view of the hull shown in FIG. 5.

In FIGS. 5–6 there is shown sealed compartment 31 having recess 20, transom 16 and top surface 32. An outboard motor if desired may be supported by top surface or wall 32 of compartment 31 which may be considered to be an appendage as shown by the dotted line which may mark the transom 16A of a conventional motor boat hull. Compartment 32 is sealed from ingress of external water as shown. Also shown is venting slot or groove 33 which allows access of air to the area below hull recess 20. Venting slot 33 is of channel shape and the extremities thereof converge towards keel 11 as shown in FIG. 6.

Figure 7:
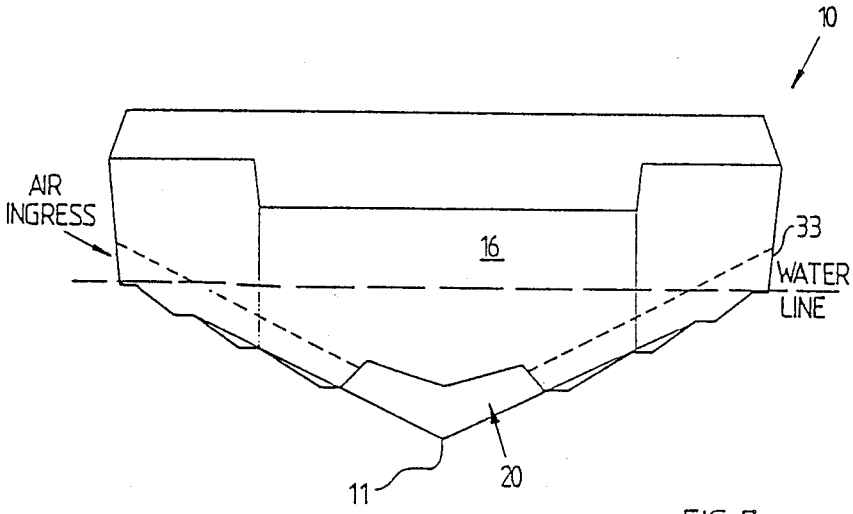
FIG. 7 is an end view of the hull of FIG. 1.

FIG. 7 shows an end view of the hull shown in FIGS. 5–6 and shows the provision of venting slots 33 which allow for air ingress above the waterline.

Figure 8:
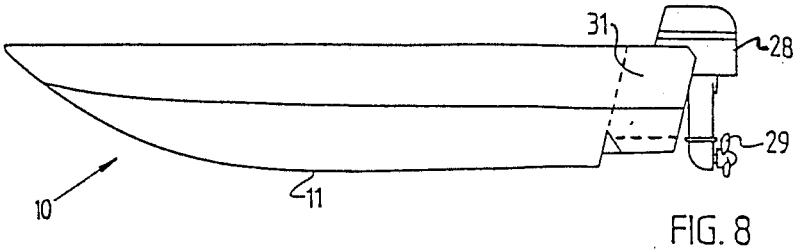
FIG. 8 is a side view of the hull of FIG. 1 powered by an outboard IC engine.
Figure 9:
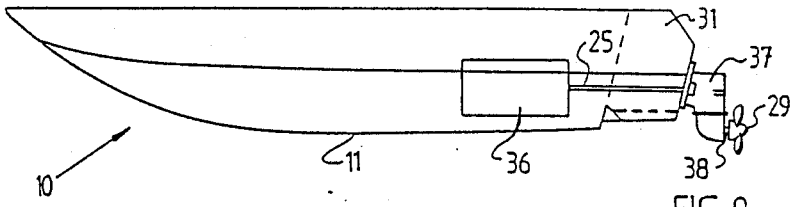
FIG. 9 is a side view of the hull of FIG. 1 powered by a stern drive IC engine.
Figure 10:
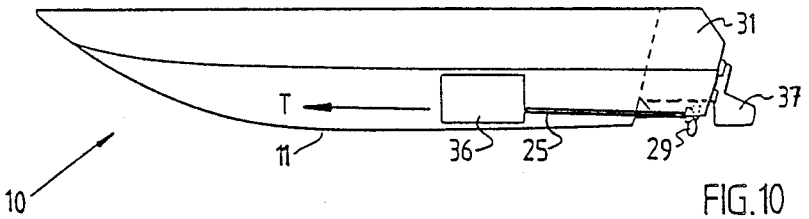
FIGS. 10 and 11 are side views of a conventional boat hull powered by an inboard IC engine.

In FIG. 8 there is shown outboard motor 28 attached to sealed compartment 31 having propeller 29. However, as shown in FIGS. 9–10 the motor boat hull 10 of the invention may also be utilised for a stern drive arrangement and an inboard arrangement respectively. In FIG. 9 there is shown IC engine 36 prop or extension shaft 25 as well as rudder 37. Extension shaft 25 may connect via a right angle gear box or similar arrangement to drive propeller 29 through output shaft 38.

In FIG. 9 there is shown an inboard arrangement wherein IC motor 36 drives shaft 25 to which is directly attached propeller 29.

The hull 10 therefore of the invention may be powered by a variety of propulsion methods as shown in FIGS. 8–10. It provides advantages of being able to give higher performance or speed with low horsepower requirements, is fuel efficient and production cost efficient.

Figure 11:
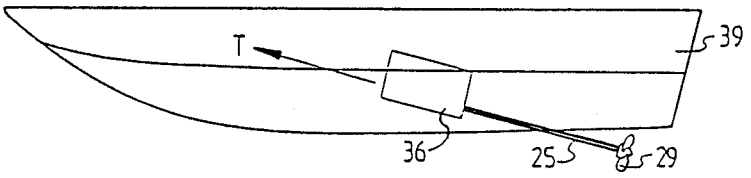

As shown in FIG. 10 the inboard arrangement provides a much reduced shaft angle and "surfacing" type propeller with the shaft 25 actually running under the transom or sealed compartment 31. The advantage of reduced prop drive shaft angle is that the propeller is running much closer to the direction of the hull in angle than the normal conventional configuration as shown in FIG. 11. The arrow T in FIGS. 10 and 11 indicates the direction of thrust and it will be appreciated from a comparison of FIGS. 10 and 11 that the hull 10 of the invention experiences far more thrust in the forward direction rather than conventional motor boat hull 39.

Figure 12:
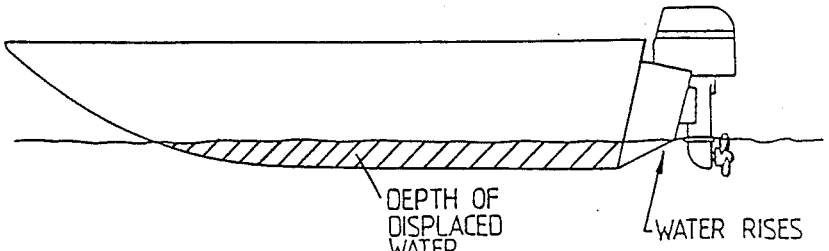
FIG. 12 is a side view of the hull of FIG. 1 showing the flow of water underneath the hull when moving through the water.

The provision of sealed compartment 31 moves the outboard motor back further (e.g. twenty to thirty inches) from the stern of a conventional hull and this becomes advantageous. Thus the outboard motor is elevated further above the water in comparison with a conventional motor boat hull. Thus water running underneath the hull rises after it passes the transom because of pressure release of water returning to its normal level after the hull has displaced it. This is shown in FIG. 12. The propeller is therefore running in water that is generally less turbulent and thus the propeller becomes more efficient. Also the outboard gear box is not as deep in the water as conventional motor boat hull creating less drag.

The provision of the transverse step 20A also provides recess 20 allowing water to become less turbulent and thus allows the hull to plane more efficiently especially with the introduction of the aforementioned venting means.

I claim:

1. A boat hull comprising a bow, a transom, a keel and an undersurface, said undersurface having a transverse step adjacent the transom which extends partially the width of the undersurface and symmetrically on opposite sides of said boat, means defining a recess at least partly bounded by said transverse step and having an end opening through said transom, and a plurality of lift strakes on each side of the keel and disposed symmetrically on opposite sides of said boat, said lift strakes on each side of said boat including an outermost lift strake having an aft end terminating adjacent said transom, at least one intermediate lift strake having an aft end terminating short of said transom and an innermost lift strake located adjacent said keel and having an aft end terminating short of the aft end of said one intermediate lift strake.

2. A boat hull according to claim 1 including venting means in said recess defining means for communicating with the atmosphere.

3. A boat hull according to claim 1 wherein each of said outermost, intermediate and innermost strakes on opposite sides of said boat merge at said bow with a corresponding strake on the other side of said boat.

4. A boat hull according to claim 2 wherein each of said outermost, intermediate and innermost strakes on opposite sides of said boat merge at said bow with a corresponding strake on the other side of said boat.

5. A boat hull comprising a bow, a transom, a keel and an undersurface, said undersurface having a transverse step adjacent the transom which extends partially the width of the undersurface and symmetrically on opposite sides of said boat, means defining a recess bounded by said transverse step, a pair of side walls, a pair of angularly related substantially planar portions located adjacent a respective side wall of the recess on each side of said keel, said recess having an end opening through said transom, and a plurality of lift strakes disposed symmetrically on opposite sides of said boat, said lift strakes on each side of said boat including an outermost lift strake having an aft end terminating adjacent said transom, at least one intermediate lift strake having an aft end terminating short of said transom and an innermost lift strake located adjacent said keel and having an aft end terminating short of said aft end of said one intermediate lift strake, and venting means in said recess defining means for communicating with the atmosphere.

6. A boat hull according to claim 5 wherein each of said outermost, intermediate and innermost strakes on opposite sides of said boat merge at said bow with a corresponding strake on the other side of said boat.

7. A boat hull comprising a bow, a transom, a keel and an undersurface, said undersurface having a transverse step adjacent the transom which extends partially the width of the undersurface and symmetrically on opposite sides of said boat, means defining a recess bounded by said transverse step and having an opening through said transom, means defining a sealed compartment located in the hull interior and situated above the recess and sealed from ingress of external water during travel, a plurality of lift strakes disposed symmetrically on opposite sides of said boat, said lift strakes on each side of said boat including an outermost lift strake having an aft end terminating adjacent said transom, at least one intermediate lift strake having an aft end terminating short of said transom and an innermost lift strake located adjacent said keel and having an aft end terminating short of said aft end of said one intermediate lift strake, and venting means in said recess defining means for communicating with the atmosphere.

8. A boat hull according to claim 7 wherein each of said outermost, intermediate and innermost strakes on opposite sides of said boat merge at said bow with a corresponding strake on the other side of said boat.

9. A boat hull comprising a bow, a transom, a keel and an undersurface, said undersurface having a transverse step adjacent the transom which extends partially the width of the undersurface and symmetrically on opposite sides of said boat, means defining a recess at least partly bounded by said transverse step and having an end opening through said transom, a plurality of lift strakes disposed symmetrically on opposite sides of said boat, said lift strakes on each side of said boat including an outermost lift strake having an aft end terminating adjacent said transom, at least one intermediate lift strake having an aft end terminating short of said transom and adjacent said transverse step and an innermost lift strake located adjacent said keel and having an aft end terminating short of the aft end of said one intermediate lift strake and said transverse step, and venting means in said recess defining means for communicating with the atmosphere.

10. A boat hull according to claim 9 wherein each of said outermost, intermediate and innermost strakes on opposite sides of said boat merge at said bow with a corresponding strake on the other side of said boat.

11. A boat hull comprising a bow, a transom, a keel and an undersurface, said undersurface having a transverse step adjacent the transom, which extends the width of said undersurface, to divide the undersurface into a corrugated part adjacent the bow and a non-corrugated part adjacent the transom wherein said corrugated part includes a plurality of lift strakes including an outermost lift strake having an aft end terminating adjacent said step, at least one intermediate lift strake terminating short of said step, and an innermost lift strake located adjacent to said keel terminating short of the aft end of said one intermediate lift strake, and said non-corrugated part having venting means communicating with the atmosphere.

12. A boat hull according to claim 11 wherein each of said outermost, intermediate and innermost strakes on opposite sides of said boat merge at said bow with a corresponding strake on the other side of said boat.

* * * * *